US005976060A

United States Patent [19]

Nunez

[11] Patent Number: 5,976,060

[45] Date of Patent: Nov. 2, 1999

[54] FOOT PEDAL FOR A STEPPING EXERCISE MACHINE

[76] Inventor: Luis Alberto Nunez, 3 KM North Iglesia De Birri, Barva Heredia 3011, Costa Rica

[21] Appl. No.: 09/121,344

[22] Filed: Jul. 23, 1998

[51] Int. Cl.[6] ..... A63B 69/16

[52] U.S. Cl. ..... 482/52; 74/594.7

[58] Field of Search ..... 482/51, 52, 53, 482/57, 148, 79, 80, 70, 71, 72; 74/594.1–594.7; 280/595; D21/191, 192, 194, 195

[56] References Cited

U.S. PATENT DOCUMENTS

| | | | |
|---|---|---|---|
| D. 360,441 | 7/1995 | Beyer | D1/191 |
| 2,323,913 | 7/1943 | Johnson | 74/594.7 |
| 2,536,466 | 1/1951 | Rippenbein | 74/594.7 |
| 3,307,425 | 3/1967 | Sykes et al. | 74/594.7 |
| 5,183,448 | 2/1993 | Wang | 482/52 |
| 5,336,142 | 8/1994 | Dalebout et al. | 482/52 |
| 5,769,760 | 6/1998 | Lin et al. | 482/52 |

*Primary Examiner*—Stephen R. Crow

[57] ABSTRACT

A foot pedal for a stepping exercise machine for stimulating the climbing and descending of a sloped surface such as when climbing or descending a mountain slope. The foot pedal includes a plate having first and second surfaces, proximal and distal end edges and a pair of side edges extending between the proximal and distal end edges of the plate. The proximal end edge of the plate is designed for pivotally mounting to a free end of a pivoting lever arm of a stepping exercise machine. The plate is pivotable with respect to the pivoting lever arm between a raised position and a lowered position. The distal end of the plate extends in an upwards direction from the pivoting lever arm when the plate is pivoted to the raised position. The distal end of the plate extends in a downwards direction from the pivoting lever arm when the plate is pivoted to the raised position.

9 Claims, 2 Drawing Sheets

FIG 1
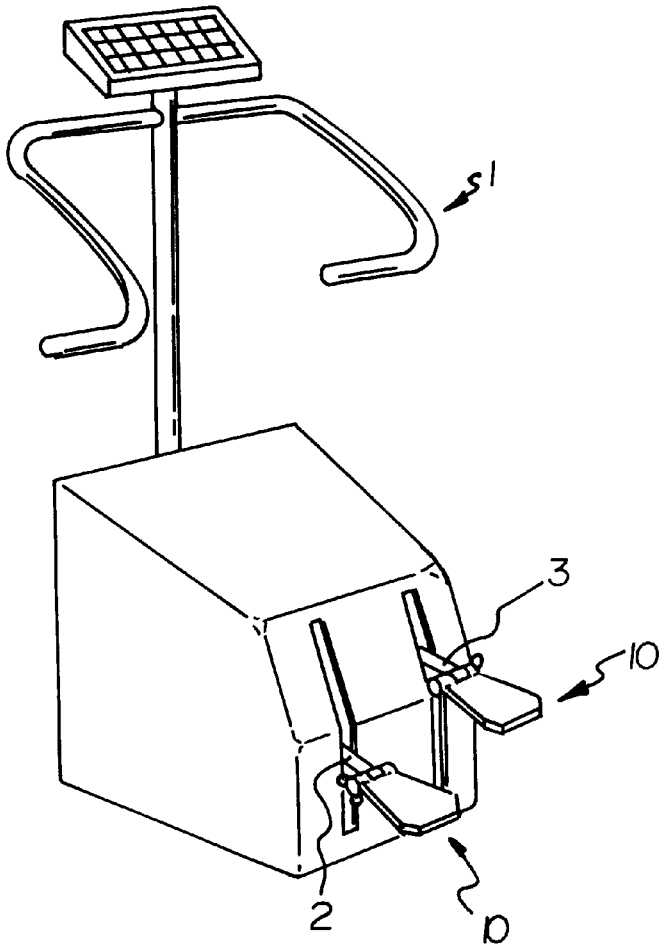
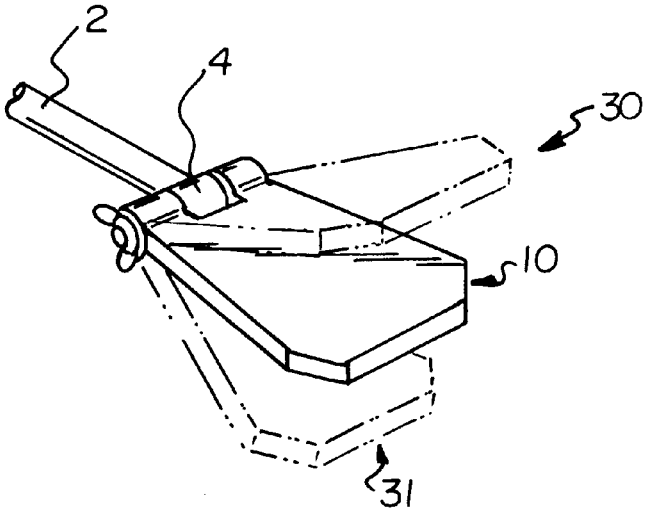
FIG 2

FOOT PEDAL FOR A STEPPING EXERCISE MACHINE

BACKGROUND OF THE INVENTION

1. Field of the Invention

The present invention relates to stepping exercise machines and more particularly pertains to a new foot pedal for a stepping exercise machine for simulating the climbing and descending of a sloped surface such as when climbing or descending a mountain slope.

2. Description of the Prior Art

The use of stepping exercise machines is known in the prior art. More specifically, stepping exercise machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art stepping exercise machines include U.S. Pat. No. 2,079,594; U.S. Pat. No. 5,336,142; U.S. Pat. No. 5,316,529; U.S. Pat. No. 5,183,448; U.S. Pat. No. Des. 360,441; and U.S. Pat. No. 3,035,671.

While these devices fulfill their respective, particular objectives and requirements, the aforementioned patents do not disclose a new foot pedal for a stepping exercise machine. The inventive device includes a plate having first and second surfaces, proximal and distal end edges and a pair of side edges extending between the proximal and distal end edges of the plate. The proximal end edge of the plate is designed for pivotally mounting to a free end of a pivoting lever arm of a stepping exercise machine. The plate is pivotable with respect to the pivoting lever arm between a raised position and a lowered position. The distal end of the plate extends in an upwards direction from the pivoting lever arm when the plate is pivoted to the raised position. The distal end of the plate extends in a downwards direction from the pivoting lever arm when the plate is pivoted to the raised position.

In these respects, the foot pedal for a stepping exercise machine according to the present invention substantially departs from the conventional concepts and designs of the prior art, and in so doing provides an apparatus primarily developed for the purpose of simulating the climbing and descending of a sloped surface such as when climbing or descending a mountain slope.

SUMMARY OF THE INVENTION

In view of the foregoing disadvantages inherent in the known types of stepping exercise machines now present in the prior art, the present invention provides a new foot pedal for a stepping exercise machine construction wherein the same can be utilized for simulating the climbing and descending of a sloped surface such as when climbing or descending a mountain slope.

The general purpose of the present invention, which will be described subsequently in greater detail, is to provide a new foot pedal for a stepping exercise machine apparatus and method which has many of the advantages of the stepping exercise machines mentioned heretofore and many novel features that result in a new foot pedal for a stepping exercise machine which is not anticipated, rendered obvious, suggested, or even implied by any of the prior art stepping exercise machines, either alone or in any combination thereof.

To attain this, the present invention generally comprises a plate having first and second surfaces, proximal and distal end edges and a pair of side edges extending between the proximal and distal end edges of the plate. The proximal end edge of the plate is designed for pivotally mounting to a free end of a pivoting lever arm of a stepping exercise machine. The plate is pivotable with respect to the pivoting lever arm between a raised position and a lowered position. The distal end of the plate extends in an upwards direction from the pivoting lever arm when the plate is pivoted to the raised position. The distal end of the plate extends in a downwards direction from the pivoting lever arm when the plate is pivoted to the raised position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot pedal for a stepping exercise machine apparatus and method which has many of the advantages of the stepping exercise machines mentioned heretofore and many novel features that result in a new foot pedal for a stepping exercise machine which is not anticipated, rendered obvious, suggested, or even implied by any of the prior art stepping exercise machines, either alone or in any combination thereof.

It is another object of the present invention to provide a new foot pedal for a stepping exercise machine which may be easily and efficiently manufactured and marketed.

It is a further object of the present invention to provide a new foot pedal for a stepping exercise machine which is of a durable and reliable construction.

An even further object of the present invention is to provide a new foot pedal for a stepping exercise machine which is susceptible of a low cost of manufacture with regard to both materials and labor, and which accordingly is then susceptible of low prices of sale to the consuming public, thereby making such foot pedal for a stepping exercise machine economically available to the buying public.

Still yet another object of the present invention is to provide a new foot pedal for a stepping exercise machine which provides in the apparatuses and methods of the prior art some of the advantages thereof, while simultaneously overcoming some of the disadvantages normally associated therewith.

Still another object of the present invention is to provide a new foot pedal for a stepping exercise machine for simulating the climbing and descending of a sloped surface such as when climbing or descending a mountain slope.

Yet another object of the present invention is to provide a new foot pedal for a stepping exercise machine which includes a plate having first and second surfaces, proximal and distal end edges and a pair of side edges extending between the proximal and distal end edges of the plate. The proximal end edge of the plate is designed for pivotally mounting to a free end of a pivoting lever arm of a stepping exercise machine. The plate is pivotable with respect to the pivoting lever arm between a raised position and a lowered position. The distal end of the plate extends in an upwards direction from the pivoting lever arm when the plate is pivoted to the raised position. The distal end of the plate extends in a downwards direction from the pivoting lever arm when the plate is pivoted to the raised position.

Still yet another object of the present invention is to provide a new foot pedal for a stepping exercise machine that allows a user to exercise muscles of the leg, especially the muscles of the leg that are not used when normally stepping on horizontal surfaces such as stairs but are used when climbing sloped surfaces such as the sloped side of a mountain or a hill.

Even still another object of the present invention is to provide a new foot pedal for a stepping exercise machine that permits the toning of the leg muscles of a user not normally toned when using an stepping exercise machine with traditional foot-pedals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new foot pedal for a stepping exercise machine according to the present invention.

FIG. 2 is a schematic perspective view of the present invention.

DESCRIPTION OF THE PREFERRED EMBODIMENT

Figure 3:
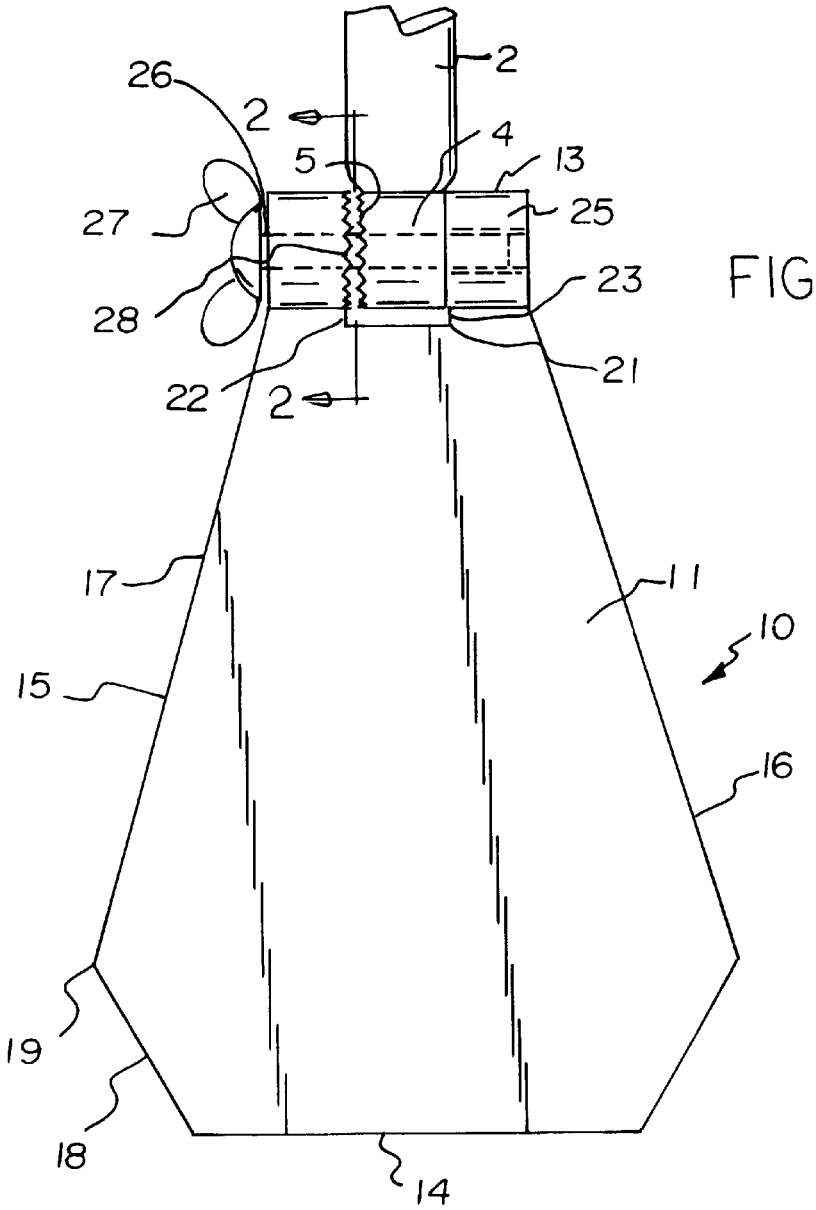
FIG. 3 is a schematic side view of the present invention.
Figure 4:
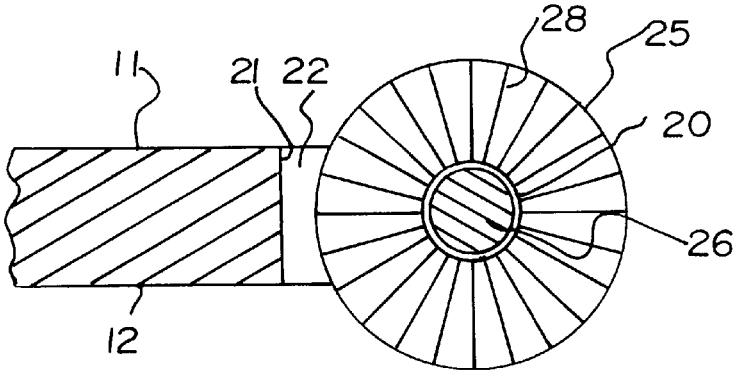
FIG. 4 is a schematic sectional view of the present invention taken from line 2—2 on FIG. 3.

With reference now to the drawings, and in particular to FIGS. 1 through 4 thereof, a new foot pedal for a stepping exercise machine embodying the principles and concepts of the present invention and generally designated by the reference numeral 10 will be described.

In use, the foot pedal 10 is designed for attachment to a free end 4 of a pivoting lever arm 2 of a stepping exercise machine 1 has a pair of pivoting lever arms 2,3 adapted for pivoting in a manner to resemble the act of stepping. Each pivoting lever arm 2 has a bore extending therethrough adjacent the free end 4 of the pivoting lever arm 2. Each of the bores has a longitudinal axis generally horizontal and extending generally perpendicular to the length of the associated pivoting lever arm. The foot pedal is designed for use in a pair for attachment to each of the pivoting lever arms 2,3 of the exercise machine 1. As best illustrated in FIGS. 1 through 4, the foot pedal for a stepping exercise machine 10 generally comprises a plate 10 having first and second surfaces 11,12, proximal and distal end edges 13,14 and a pair of side edges 15,16 extending between the proximal and distal end edges 13,14 of the plate 10. The proximal end edge 13 of the plate 10 is designed for pivotally mounting to a free end 4 of a pivoting lever arm 2 of a stepping exercise machine 1. The plate 10 is pivotable with respect to the pivoting lever arm 2 between a raised position 30 and a lowered position 31. The distal end of the plate 10 extends in an upwards direction from the pivoting lever arm 2 when the plate 10 is pivoted to the raised position 30. The distal end of the plate 10 extends in a downwards direction from the pivoting lever arm 2 when the plate 10 is pivoted to the raised position 30.

In closer detail, the plate 10 has first and second surfaces 11,12, proximal and distal end edges 13,14 and a pair of side edges 15,16 extending between the proximal and distal end edges 13,14 of the plate 10. Each of the first and second surfaces 11,12 are preferably generally planar and the proximal and distal end edges 13,14 of the plate 10 preferably lie in generally parallel planes. Preferably, the length of the distal end edge 14 of the plate 10 is greater than the length of the proximal end edge 13 of the plate 10 such that the side edges 15,16 of the plate 10 converge towards the proximal end of the plate 10. Each of the side edges 15,16 of the plate 10 has proximal and distal portions 17,18. The proximal portions 17 of the side edges 15,16 is located adjacent the proximal end edge 13 of the plate 10 while the distal portions 18 of the side edges 15,16 is located adjacent the distal end edge 14 of the plate 10. The proximal portion 17 of each of the side edges 15,16 is extended at an obtuse angle from the proximal end edge 13 of the plate 10 and the distal portion 18 of each of the side edges 15,16 is extended at an obtuse angle from the distal end edge 14 of the plate 10. The proximal portion 17 of each side edge intersects the associated distal portion 18 of the side edge at a vertex 19 such that the proximal portion 17 is extended at an angle to the distal portion 18 and not a straight line so that the vertex 19 forms an angle less than 180 degrees. Preferably, the angle formed by the vertex 19 is between about 120 degrees and about 150 degrees. Ideally, the angle formed by the vertex 19 is about 135 degrees.

The plate 10 has an elongate mounting bore 20 extending therethrough between the side edges of the plate 10. The mounting bore 20 of the plate 10 is generally cylindrical and has a longitudinal axis. The mounting bore 20 of the plate 10 is located adjacent proximal end edge 13 of the plate 10 with the longitudinal axis of the mounting bore 20 of the plate 10 extended generally parallel with the length of the proximal end edge 13 of the plate 10.

The proximal end edge 13 of the plate 10 has a cutout 21 extending through the first and second surfaces 11,12 of the plate 10. The cutout 21 extends transversely through the mounting bore 20 of the plate 10 such that the cutout 21 provides an opening into the mounting bore 20 of the plate 10. The cutout 21 preferably has a pair of side walls 22,23 and an end wall 24 forming a generally rectangular periphery of the cutout 21. The end wall 24 of the cutout 21 preferably lies in a plane generally parallel to the plane of the proximal end edge 13 of the plate 10 while the side walls 22,23 of the cutout 21 lie in generally perpendicular planes to the plane of the proximal end edge 13 of the plate 10. The longitudinal axis of mounting bore 20 of the plate 10 extends through the side walls 22,23 of the cutout 21 with the side walls 22,23 lying in planes generally perpendicular to the longitudinal axis of the mounting bore 20 of the plate 10. Preferably, the plate 10 has a generally cylindrical reinforcing portion 25 positioned adjacent the proximal end edge 13 of the plate 10. The reinforcing portion 25 has a length extending between the side edges 15,16 of the plate 10. The reinforcing portion 25 has a longitudinal axis coaxial with the longitudinal axis of the mounting bore 20 of the plate 10. The cutout 21 extends transversely through the reinforcing portion 25 such that the diameter of the reinforcing portion 25 is positioned between the proximal end edge 13 and the end wall 24 of the cutout 21.

The cutout 21 is designed for receiving a free end 4 of a pivoting lever arm 2 of an exercise machine 1 such that a bore through the pivoting lever arm 2 is coaxial with the mounting bore 20 of the plate 10. A threaded bolt 26 is provided for extending through the mounting bore 20 and the bore of the pivoting lever arm 2 to pivotally fasten the plate 10 to the free end 4 of the pivoting lever arm 2. A thumb nut 27 is threaded on to an end of the threaded bolt 26 to secure the threaded bolt 26 in the bore of the pivoting lever arm 2 and the mounting bore 20 of the plate 10. As illustrated in FIG. 2, the plate 10 is pivotable with respect to the free end 4 of the pivoting lever arm 2 at the longitudinal axis of the mounting bore 20 of the plate 10. The plate 10 is pivotable between a raised position 30 and a lowered position 31. The raised position 30 is designed for simulating the stepping down or descending of a slope. The lowered position 31 is designed for simulating the stepping up or climbing of a slope. The plate 10 lies in a plane at an obtuse angle with respect to the length of the pivoting lever arm 2 in both the raised position 30 and the lowered position 31. The distal end of the plate 10 extends in an upwards direction from the pivoting lever arm 2 when the plate 10 is pivoted in the raised position 30. The distal end of the plate 10 extends in a downwards direction from the pivoting lever arm 2 when the plate 10 is pivoted in the raised position 30. The thumb nut 27 is tightenable on the threaded bolt 26 to hold the plate 10 in the raised and lowered positions 30,31. Ideally, one of the side walls 22 of the cutout 21 has a plurality of ridges 28 radiating outwards from the mounting bore 20. The ridges 28 of the cutout 21 engage or mesh with similar ridges 5 on the pivoting lever arm 2 around the bore of the pivoting lever arm 2 to help hold the plate 10 in a position with respect to the pivoting lever arm 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot pedal for attachment to a free end of a pivoting lever arm of a stepping exercise machine having a pair of pivoting lever arms adapted for pivoting in a manner to resemble the act of stepping, said foot pedal comprising:

a plate having first and second surfaces, proximal and distal end edges and a pair of side edges extending between said proximal and distal end edges of said plate; and said proximal end edge of said plate being adapted for pivotally mounting to a free end of a pivoting lever arm of a stepping exercise machine, said plate being pivotable with respect to the pivoting lever arm between a raised position and a lowered position, said distal end of said plate extending in an upwards direction from the pivoting lever arm when said plate is pivoted to said raised position, said distal end of said plate extending in a downwards direction from the pivoting lever arm when said plate is pivoted to said raised position and means for locking said plate between said raised and lowered positions.

2. The foot pedal of claim 1, wherein each of said first and second surfaces being generally planar, and wherein said proximal and distal end edges of said plate lie in generally parallel planes.

3. The foot pedal of claim 1, wherein said proximal and distal end edges of said plate each have a length, wherein said length of said distal end edge of said plate is greater than said length of said proximal end edge of said plate.

4. The foot pedal of claim 1, wherein each of said side edges of said plate has proximal and distal portions, said proximal portions of said side edges being located adjacent said proximal end edge of said plate, said distal portions of said side edges being located adjacent said distal end edge of said plate, wherein said proximal portion of each of said side edges are extended at an obtuse angle from said proximal end edge of said plate, and wherein said distal portion of each of said side edges are extended at an obtuse angle from said distal end edge of said plate.

5. The foot pedal of claim 4, wherein said proximal portion of each side edge intersects the associated distal portion of said side edge at a vertex, said vertex forming an angle less than 180 degrees.

6. The foot pedal of claim 5, wherein said angle formed by said vertex is between about 120 degrees and about 150 degrees.

7. The foot pedal of claim 5, wherein said angle formed by said vertex is about 135 degrees.

8. The foot pedal of claim 1, wherein said plate has an elongate mounting bore extending therethrough between said sides of said plate, wherein said proximal end edge of said plate has a cutout extending through said first and second surfaces of said plate, said cutout extending through said mounting bore of said plate such that said cutout provides an opening into said mounting bore of said plate, said cutout being adapted for receiving a free end of a pivoting lever arm of an exercise machine such that a bore through the pivoting lever arm is coaxial with said mounting bore of said plate, wherein a threaded bolt is provided for extending through said mounting bore and the bore of the pivoting lever arm to pivotally fasten said plate to the free end of the pivoting lever arm, and wherein a nut is threaded on to said threaded bolt.

9. A foot pedal for attachment to a free end of a pivoting lever arm of a stepping exercise machine having a pair of pivoting lever arms adapted for pivoting in a manner to resemble the act of stepping, each pivoting lever arm having a bore extending therethrough adjacent the free end of the pivoting lever arm, each of the bores having a longitudinal axis generally horizontal and extending generally perpendicular to the length of the associated pivoting lever arm, said foot pedal being for use in a pair of foot pedals for attachment to each of the pivoting lever arms of the exercise machine, said foot pedal comprising:

a plate having first and second surfaces, proximal and distal end edges and a pair of side edges extending between said proximal and distal end edges of said plate;

each of said first and second surfaces being generally planar;

said proximal and distal end edges of said plate lying in generally parallel planes;

said proximal and distal end edges of said plate each having a length, wherein said length of said distal end edge of said plate is greater than said length of said proximal end edge of said plate;

each of said side edges of said plate having a proximal and distal portions, said proximal portions of said side edges being located adjacent said proximal end edge of said plate, said distal portions of said side edges being located adjacent said distal end edge of said plate;

said proximal portion of each of said side edges being extended at an obtuse angle from said proximal end edge of said plate;

said distal portion of each of said side edges being extended at an obtuse angle from said distal end edge of said plate;

said proximal portion of each side edge intersecting the associated distal portion of said side edge at a vertex, wherein said angle formed by said vertex is about 135 degrees;

said plate having an elongate mounting bore extending therethrough between said sides of said plate;

said mounting bore of said plate being generally cylindrical and having a longitudinal axis, said mounting bore of said plate being adjacent proximal end edge of said plate, said longitudinal axis of said mounting bore of said plate being extended generally parallel with of said proximal end edge of said plate;

said proximal end edge of said plate having a cutout extending through said first and second surfaces of said plate, said cutout extending transversely through said mounting bore of said plate such that said cutout provides an opening into said mounting bore of said plate;

said cutout having a pair of side walls and an end wall forming a generally rectangular periphery of said cutout;

said end wall of said cutout lying in a plane generally parallel to said proximal end edge of said plate, said side walls of said cutout lying in generally perpendicular planes to said proximal end edge of said plate;

said longitudinal axis of mounting bore of said plate extending through said side walls of said cutout, said side walls lying in planes generally perpendicular to said longitudinal axis of said mounting bore of said plate;

said plate having a generally cylindrical reinforcing portion positioned adjacent said proximal end edge of said plate;

said reinforcing portion having a length extending between said side edges of said plate;

said reinforcing portion having a longitudinal axis coaxial with said longitudinal axis of said mounting bore of said plate;

said cutout extending transversely through said reinforcing portion such that said reinforcing portion is positioned between said proximal end edge and said end wall of said cutout;

said cutout being adapted for receiving a free end of a pivoting lever arm of an exercise machine such that a bore through the pivoting lever arm is coaxial with said mounting bore of said plate;

a threaded bolt being adapted for extending through said mounting bore and the bore of the pivoting lever arm to pivotally fasten said plate to the free end of the pivoting lever arm;

a nut being threaded on to said threaded bolt; and said plate being pivotable with respect to the free end of the pivoting lever arm at said longitudinal axis of said mounting bore of said plate and means for locking said plate between said raised and lowered positions.

* * * * *